US005796174A

United States Patent [19]

Nam

[11] Patent Number: 5,796,174

[45] Date of Patent: Aug. 18, 1998

[54] DEVICE FOR CONTROLLING BREAKER IN CONSTRUCTION VEHICLES

[75] Inventor: In Taek Nam, Namyangju, Rep. of Korea

[73] Assignee: Samsung Heavy Industries Co., Ltd., Rep. of Korea

[21] Appl. No.: 762,954

[22] Filed: Dec. 10, 1996

[30] Foreign Application Priority Data

Jun. 26, 1996 [KR] Rep. of Korea ..... 1996-24089

[51] Int. Cl.[6] ..... F02M 39/00

[52] U.S. Cl. ..... 307/9.1; 307/10.1; 307/31; 307/38; 200/82 B

[58] Field of Search ..... 307/9.1, 10.1, 307/112, 115, 139, 140, 11, 30, 31, 38, 39; 200/82 B

[56] References Cited

U.S. PATENT DOCUMENTS

| | | | |
|---|---|---|---|
| 4,101,746 | 7/1978 | Grieger et al. | 200/82 B |
| 4,125,885 | 11/1978 | Lowther et al. | 307/115 |
| 4,350,319 | 9/1982 | Kawata et al. | 251/65 |
| 4,572,963 | 2/1986 | Nakano et al. | 307/115 |
| 4,643,146 | 2/1987 | Spiessler | 414/699 |
| 4,841,159 | 6/1989 | Evans et al. | 307/10.1 |
| 4,889,466 | 12/1989 | Jindai et al. | 414/694 |
| 5,502,290 | 3/1996 | Koyanagi et al. | 200/82 B |
| 5,528,335 | 6/1996 | Terunuma | 307/39 |

*Primary Examiner*—Ronald W. Leja
*Assistant Examiner*—Peter Ganjian
*Attorney, Agent, or Firm*—Harness, Dickey & Pierce, P.L.C.

[57] ABSTRACT

A device for controlling a breaker in construction vehicles is disclosed. The device includes a control circuit provided with a power supply, a first solenoid valve used for controlling the breaker, and a second solenoid valve used for boosting the relief pressure of the circuit. The device also includes a control switch and a select switch. The control switch is installed in a control lever and is handled by an operator in order to selectively open or close the control circuit. Meanwhile, the select switch is connected between the control switch, power supply and first and second solenoid valves. The select switch selectively connects the power supply to the first or second solenoid valve in order to select either of the breaker and pressure boosting operations, which are commonly controlled by the control switch.

2 Claims, 1 Drawing Sheet

DEVICE FOR CONTROLLING BREAKER IN CONSTRUCTION VEHICLES

BACKGROUND OF THE INVENTION

1. Field of the Invention

The present invention relates, in general, to a device for controlling the operation of a breaker in construction vehicles and, more particularly, to a structural improvement in such a breaker control device for selectively controlling a breaker operation or a relief pressure boosting operation by a single control unit.

2. Description of the Prior Art

As well known to those skilled in the art, a breaker and relief pressure of a construction vehicle are typically controlled by respective control units. When it is necessary to use a breaker during the operation of a construction vehicle, for example, a power excavator, the breaker in place of a bucket is attached to the tip of a dipper stick and is intensely vibrated in order to apply vibrational impact onto an object. FIG. 1 is a circuit diagram showing the construction of a typical control circuit of a construction vehicle, including both a breaker control unit and a pressure boosting control unit. During a breaker operation of the construction vehicle, the position of the breaker 107 is determined by handling a boom and dipper stick control lever. After the breaker 107 is placed on the selected position relative to an object, the vibrating operation of the breaker 107 is controlled by operating a control pedal 104. In the above circuit, the control pedal 104 acts as a switch which opens or closes the circuit in order to selectively supply electric power to a first solenoid valve 102 corresponding to the breaker 107. In FIG. 1, the reference numeral 101 denotes an electric power supply.

On the other hand, the pressure boosting operation is for boosting the relief pressure in a hydraulic system 108 of a construction vehicle. The boosting operation is controlled by operating a switch 106, which is installed in the control lever 105 as shown in FIG. 1. The switch 106 thus selectively applies electric power of the power supply 101 to a second solenoid valve 103 corresponding to the relief pressure, so that the relief pressure of the hydraulic system 108 is selectively boosted.

In the breaker operation of the construction vehicle, the boom and dipper stick control lever is primarily handled by an operator in order to set the breaker on a precise position relative to an object. Thereafter, the control pedal 104 is continuously levered in order to actuate the breaker 107 during the breaker operation, so that the typical unit for controlling the breaker 107 is inconvenient to the operator.

Therefore, the typical breaker control unit reduces work efficiency during the breaker operation.

SUMMARY OF THE INVENTION

It is, therefore, an object of the present invention to provide a device for controlling a breaker in construction vehicles in which the above problems can be overcome and which selectively controls a breaker operation or a relief pressure boosting operation by a single control unit, thereby remarkably improving work efficiency during the breaker operation.

In order to accomplish the above object, the present invention provides a device for controlling a breaker in construction vehicles, comprising a control circuit provided with a power supply, a first solenoid valve used for controlling the breaker, and a second solenoid valve used for boosting a relief pressure in a hydraulic system of a construction vehicle, further comprising a control switch, which is installed in a control lever and is handled by an operator in order to selectively open or close the control circuit. A select switch is connected between the control switch, power supply and first and second solenoid valves, and selectively connects the power supply to the first or second solenoid valve thereby selecting either of the breaker and pressure boosting operations, which are commonly controlled by the control switch.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
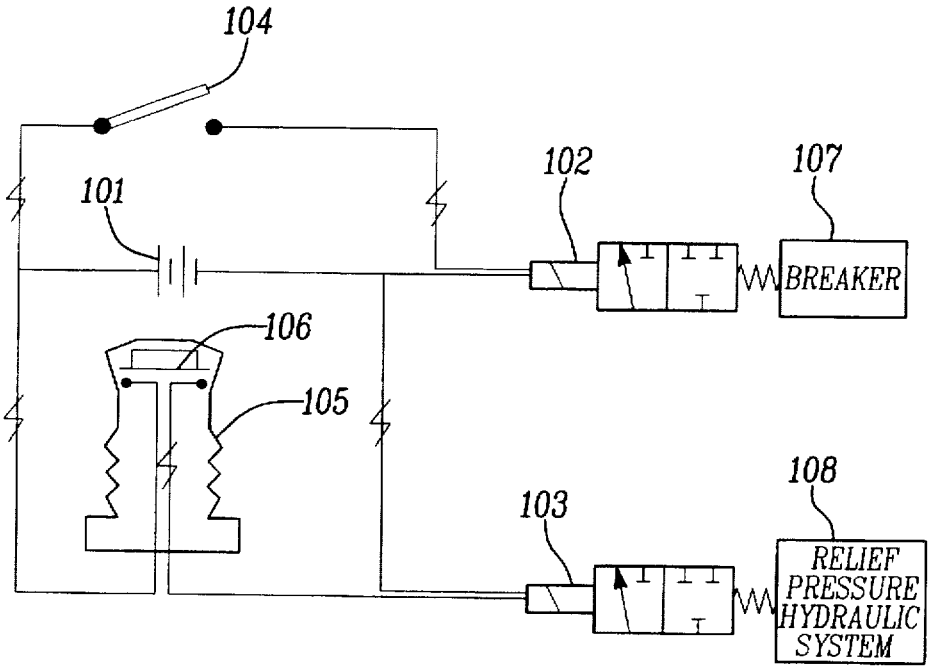
Fig-1 PRIOR ART
FIG. 1 is a circuit diagram showing the construction of a typical control circuit of a construction vehicle, including both a breaker control unit and a pressure boosting control unit.
Figure 2:
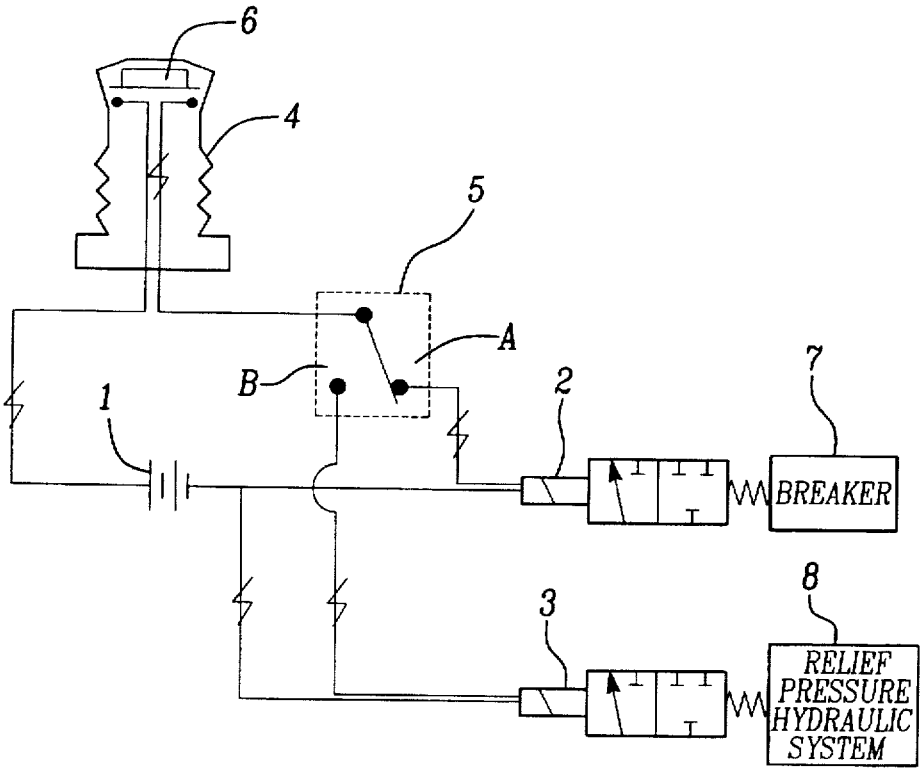
FIG. 2 is a circuit diagram showing the construction of a control circuit of a construction vehicle, including a breaker control device in accordance with the preferred embodiment of the present invention.

FIG. 2 is a circuit diagram showing the construction of a control circuit of a construction vehicle, including a breaker control device in accordance with the preferred embodiment of the present invention.

As shown in FIG. 2, the breaker control device comprises a control circuit, which is provided with a power supply 1, a first solenoid valve 2 used for controlling the breaker 7, and a second solenoid valve 3 used for boosting the relief pressure in a hydraulic system 8 of a construction vehicle. The breaker control device also includes a control switch 6 which is installed in a control lever 4. The control switch is handled by an operator in order to selectively open or close the control circuit. In the control circuit, a select switch 5 is connected between the control switch 6, power supply 1 and first and second solenoid valves 2 and 3. The select switch 5 selectively connects the power supply 1 to the first or second solenoid valve 2, 3 in order to select either of the breaker and pressure boosting operations, which are commonly controlled by the control switch 6. The above select switch 5 is switched between "A" and "B" positions. When the select switch 5 is switched into the "A" position, the device controls a breaker operation. Meanwhile, when the select switch 5 is switched into the "B" position, the device controls a pressure boosting operation. FIG. 2 shows the device of which the select switch 5 is switched into the "A" position. That is, the control switch 6 is selectively used for controlling the breaker operation or the pressure boosting operation in accordance with a switching operation of the select switch 5.

The operational effect of the above breaker control device will be described hereinbelow.

When it is necessary to use the control switch 6 in a pressure boosting operation, the select switch 5 is switched into the "B" position prior to handling the control switch 6.

Electric power of the power supply 1 is thus applied to the second solenoid valve 3 through both the control switch 6 and the select switch 5. The device in the above state controls a pressure boosting operation.

On the other hand, when it is necessary to control a breaker operation, the select switch 5 is switched into the "A" position prior to handling the control switch 6.

Therefore, electric power of the power supply 1 is applied to the first solenoid valve 2 through both the control switch 6 and the select switch 5. The device in the above state controls a breaker operation.

As described above, the present invention provides a device for controlling a breaker in construction vehicles.

The device includes a control circuit provided with a power supply, a first solenoid valve used for controlling the breaker, and a second solenoid valve used for boosting the relief pressure in a hydraulic system of a construction vehicle. The device also includes a control switch and a select switch. The control switch is installed in a control lever and is handled by an operator in order to selectively open or close the control circuit. The select switch is connected between the control switch, power supply and first and second solenoid valves, and selectively connects the power supply to the first or second solenoid valve in order to select either of the breaker and pressure boosting operations, which are commonly controlled by the control switch. Therefore, the device overcomes the problem in that a control pedal must be continuously levered in order to actuate the breaker during the breaker operation. The breaker control device of this invention is convenient to the operator.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A device for controlling a breaker in construction vehicles, comprising a control circuit provided with a power supply, a first solenoid valve used for controlling the breaker, and a second solenoid valve used for boosting a relief pressure in a hydraulic system of the construction vehicle further comprising:

a control switch installed in a control lever and handled by an operator in order to selectively open or close said control circuit; and a select switch connected between said control switch, power supply and first and second solenoid valves, and adapted for selectively connecting said power supply to the first or second solenoid valve in order to select either of the breaker and pressure boosting operations commonly controlled by said control switch.

2. A control circuit for a construction vehicle, said control circuit comprising:

a power supply;

a control switch operably connected to said power supply;

a first solenoid for controlling a breaker;

a second solenoid for boosting a relief pressure; and a select switch operably connected to said control switch, said first solenoid, and said second solenoid; said select switch positionable between at least a first position and a second position; said first position of said select switch interconnecting said power supply, said control switch, and said first solenoid; said second position of said select switch interconnecting said power supply, said control switch, and said second solenoid.

* * * * *